US007138040B2

(12) United States Patent
Okabe et al.

(10) Patent No.: US 7,138,040 B2
(45) **Date of Patent: *Nov. 21, 2006**

(54) ELECTROLYTIC COPPER PLATING METHOD, PHOSPHOROUS COPPER ANODE FOR ELECTROLYTIC PLATING METHOD, AND SEMICONDUCTOR WAFER HAVING LOW PARTICLE ADHESION PLATED WITH SAID METHOD AND ANODE

(75) Inventors: Takeo Okabe, Ibaraki (JP); Akihiro Aiba, Ibaraki (JP); Junnosuke Sekiguchi, Ibaraki (JP); Hirohito Miyashita, Ibaraki (JP); Ichiroh Sawamura, Ibaraki (JP)

(73) Assignee: Nippon Mining & Metals Co., Ltd. (JP)

( * ) Notice: Subject to any disclaimer, the term of this patent is extended or adjusted under 35 U.S.C. 154(b) by 569 days.

This patent is subject to a terminal disclaimer.

(21) Appl. No.: 10/362,152

(22) PCT Filed: Jul. 11, 2002

(86) PCT No.: PCT/JP02/07038

§ 371 (c)(1),
(2), (4) Date: Feb. 19, 2003

(87) PCT Pub. No.: WO03/035943

PCT Pub. Date: May 1, 2003

(65) Prior Publication Data

US 2004/0007474 A1 Jan. 15, 2004

(30) Foreign Application Priority Data

Oct. 22, 2001 (JP) ..... 2001-323265

(51) Int. Cl.
*C25B 11/04* (2006.01)
*C25D 3/38* (2006.01)

(52) U.S. Cl. ..... 204/292; 204/291; 204/293; 205/291; 205/292

(58) Field of Classification Search ..... 205/292, 205/291; 204/291, 292, 293
See application file for complete search history.

(56) References Cited

U.S. PATENT DOCUMENTS 6,503,375 B1 1/2003 Maydan et al. ..... 204/242

(Continued)

FOREIGN PATENT DOCUMENTS

EP 1249517 A1 10/2002

(Continued)

OTHER PUBLICATIONS

Kalev et al., "Production of Phosphorus-Containing Copper Anodes by Counter-Pressure Casting", Tekhnicheska Misul (no month, 1982), vol. 19, No. 1, pp. 101-107. Abstract Only.*

(Continued)

*Primary Examiner*—Edna Wong
(74) *Attorney, Agent, or Firm*—Howson and Howson

(57) ABSTRACT

An electrolytic copper plating method characterized in employing phosphorous copper as the anode upon performing electrolytic copper plating, and performing electrolytic copper plating upon making the crystal grain size of the phosphorous copper anode 10 to 1500 μm when the anode current density during electrolysis is 3 A/dm$^2$ or more, and making the grain size of the phosphorous copper anode 5 to 1500 μm when the anode current density during electrolysis is less than 3 A/dm$^2$. The electrolytic copper plating method and phosphorous copper anode used in such electrolytic copper plating method is capable of suppressing the generation of particles such as sludge produced on the anode side within the plating bath, and is capable of preventing the adhesion of particles to a semiconductor wafer. A semiconductor wafer plated with the foregoing method and anode having low particle adhesion are provided.

14 Claims, 1 Drawing Sheet

U.S. PATENT DOCUMENTS

| | | | | |
|---|---|---|---|---|
| 6,531,039 | B1 * | 3/2003 | Kohut | 204/292 |
| 6,689,257 | B1 * | 2/2004 | Mishima et al. | 204/224 R |
| 2002/0000371 | A1 * | 1/2002 | Mishima et al. | 204/199 |
| 2004/0149588 | A1 * | 8/2004 | Aiba et al. | 205/292 |

FOREIGN PATENT DOCUMENTS

| | | |
|---|---|---|
| JP | 2001-192890 | 7/2001 |
| JP | 2001-271196 | 10/2001 |
| JP | 2001-316886 | 11/2001 |
| JP | 2002-173795 | 6/2002 |

OTHER PUBLICATIONS

Patent Abstracts of Japan, One page English Abstract of JP 2001-192890.

Patent Abstracts of Japan, One page English Abstract of JP 2002-173795.

Co-Pending U.S. Appl. No. 09/980,947 filed on Dec. 5, 2001, will issue on May 13, 2003.

* cited by examiner

ELECTROLYTIC COPPER PLATING METHOD, PHOSPHOROUS COPPER ANODE FOR ELECTROLYTIC PLATING METHOD, AND SEMICONDUCTOR WAFER HAVING LOW PARTICLE ADHESION PLATED WITH SAID METHOD AND ANODE

FIELD OF THE INVENTION

The present invention pertains to an electrolytic copper plating method and a phosphorous copper anode used in such electrolytic copper plating method capable of suppressing the generation of particles such as sludge produced on the anode side within the plating bath, and in particular capable of preventing the adhesion of particles to a semiconductor wafer, as well as to a semiconductor wafer having low particle adhesion plated with the foregoing method and anode.

BACKGROUND OF THE INVENTION

Generally, although an electrolytic copper plate has been employed for forming copper wiring in a PWB (print wiring board) or the like, in recent years, it is being used for forming copper wiring of semiconductors. An electrolytic copper plate has a long history, and it has reached its present form upon accumulating numerous technical advancements. Nevertheless, when employing this electrolytic copper plate for forming copper wiring of semiconductors, a new problem arose which was not found in a PWB.

Ordinarily, when performing electrolytic copper plating, phosphorous copper is used as the anode. This is because when an insoluble anode formed from the likes of platinum, titanium, or iridium oxide is used, the additive within the plating liquid would decompose upon being affected by anodic oxidization, and inferior plating will occur thereby. Moreover, when employing electrolytic copper or oxygen-free copper of a soluble anode, a large amount of particles such as sludge is generated from metallic copper or copper oxide caused by the disproportionation reaction of monovalent copper during dissolution, and the object to be plated will become contaminated as a result thereof.

On the other hand, when employing a phosphorous copper anode, a black film composed of copper phosphide and copper chloride is formed on the anode surface due to electrolysis, and it is thereby possible to suppress the generation of metallic copper or copper oxide caused by the disproportionation reaction of monovalent copper, and to control the generation of particles.

Nevertheless, even upon employing phosphorous copper as the anode as described above, it is not possible to completely control the generation of particles since metallic copper or copper oxide is produced where the black film drops off or at portions where the black film is thin.

In light of the above, a filter cloth referred to as an anode bag is ordinarily used to wrap the anode so as to prevent particles from reaching the plating liquid.

Nevertheless, when this kind of method is employed, particularly in the plating of a semiconductor wafer, there is a problem in that minute particles, which were not a problem in forming the wiring of a PWB and the like, reach the semiconductor wafer, such particles adhere to the semiconductor, and thereby cause inferior plating.

OBJECT OF THE INVENTION

The present invention aims to provide an electrolytic copper plating method and a phosphorous copper anode used in such electrolytic copper plating method capable of suppressing the generation of particles such as sludge produced on the anode side within the plating bath, and in particular capable of preventing the adhesion of particles to a semiconductor wafer, as well as to a semiconductor wafer having low particle adhesion plated with the foregoing method and anode.

SUMMARY OF THE INVENTION

In order to achieve the foregoing object, as a result of intense study, the present inventors discovered that a semiconductor wafer and the like having low particle adhesion can be manufactured stably by improving the electrode material, and suppressing the generation or particles in the anode.

Based on the foregoing discovery, the present invention provides:

1. An electrolytic copper plating method characterized in employing phosphorous copper as the anode upon performing electrolytic copper plating, and performing electrolytic copper plating upon making the crystal grain size of the phosphorous copper anode 10 to 1500 μm when the anode current density during electrolysis is 3 A/dm$^2$ or more, and making the grain size of the phosphorous copper anode 5 to 1500 μL m when the anode current density during electrolysis is less than 3 A/dm$^2$.
2. An electrolytic copper plating method characterized in employing phosphorous copper as the anode upon performing electrolytic copper plating, and performing electrolytic copper plating upon making the crystal grain size of the phosphorous copper anode 20 to 700 μm when the anode current density during electrolysis is 3 A/dm$^2$ or more, and making the grain size of the phosphorous copper anode 10 to 700 μm when the anode current density during electrolysis is less than 3 A/dm$^2$.
3. An electrolytic copper plating method according to paragraph 1 or paragraph 2 above, wherein the phosphorous content of the phosphorous copper anode is 50 to 2000 wtppm.
4. An electrolytic copper plating method characterized in employing phosphorous copper as the anode upon performing electrolytic copper plating, and forming in advance a minute crystal layer having a crystal grain size of 1 to 100 μm on the surface of the phosphorous copper anode.
5. An electrolytic copper plating method according to each of paragraphs 1 to 3 above, characterized in employing phosphorous copper as the anode upon performing electrolytic copper plating, and forming in advance a minute crystal layer having a crystal grain size of 1 to 100 μm on the surface of the phosphorous copper anode.
6. An electrolytic copper plating method according to each of paragraphs 1 to 3 and paragraph 5 above, characterized in that the phosphorous copper anode surface has a black film layer with a thickness of 1000 μm or less and having copper phosphide or copper chloride as its principle component.
7. A phosphorous copper anode for electrolytic copper plating characterized in that phosphorous copper is used as the anode for performing electrolytic copper plating, and the crystal grain size of the phosphorous copper anode is 5 to 1500 μm.

8. A phosphorous copper anode for electrolytic copper plating characterized in that phosphorous copper is used as the anode for performing electrolytic copper plating, and the crystal grain size of the phosphorous copper anode is 10 to 700 μm.
9. A phosphorous copper anode for electrolytic copper plating according to paragraph 7 or paragraph 8 above, wherein the phosphorous content of the phosphorous copper anode is 50 to 2000 wtppm.
10. A phosphorous copper anode for electrolytic copper plating characterized in that phosphorous copper is used as the anode for performing electrolytic copper plating, and a minute crystal layer having a crystal grain size of 1 to 100 μm is formed in advance on the surface of the phosphorous copper anode.
11. A phosphorous copper anode for electrolytic copper plating according to each of paragraphs 7 to 9 above, characterized in that phosphorous copper is used as the anode for performing electrolytic copper plating, and a minute crystal layer having a crystal grain size of 1 to 100 μm is formed in advance on the surface of the phosphorous copper anode.
12. A phosphorous copper anode for electrolytic copper plating according to each of paragraphs 7 to 9 and paragraph 11 above, characterized in that the phosphorous copper anode surface has a black film layer with a thickness of 1000 μm or less and having copper phosphide or copper chloride as its principle component.
13. An electrolytic copper plating method and a phosphorous copper anode for electrolytic copper plating according to each of paragraphs 1 to 12 above, characterized in that the electrolytic copper plating is to be performed on a semiconductor wafer.
14. A semiconductor wafer having low particle adhesion plated with the electrolytic copper plating method and the phosphorous copper anode for electrolytic copper plating according to each of paragraphs 1 to 13 above.

DETAILED DESCRIPTION OF THE PREFERRED EMBODIMENTS

Figure 1:
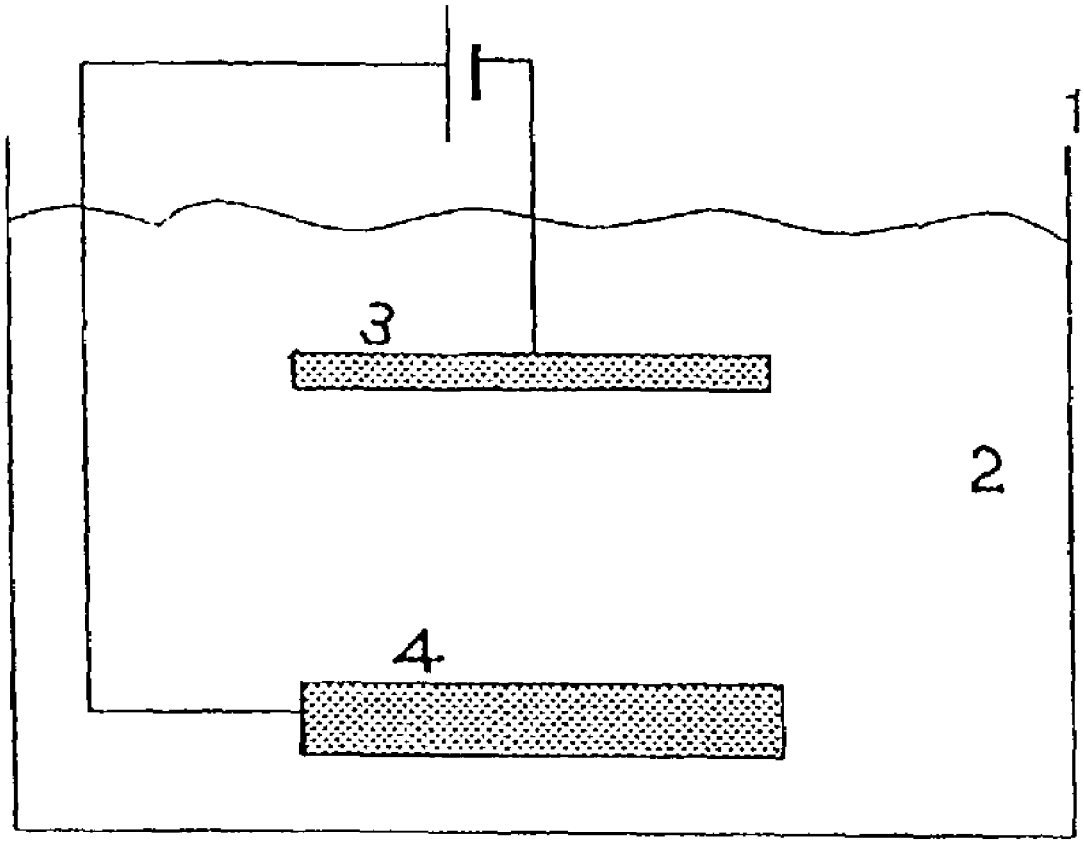
FIG. 1 is a conceptual diagram of a device used in the electrolytic copper plating method of a semiconductor according to the present invention.

FIG. 1 is a diagram illustrating an example of the device employed in the electrolytic copper plating method of a semiconductor wafer. This copper plating device comprises a tank 1 having copper sulfate plating liquid 2. An anode 4 composed of a phosphorous copper anode as the anode is used, and, as the cathode 3, for example, a semiconductor wafer is used as the object of plating.

As described above, when employing phosphorous copper as the anode upon performing electrolytic plating, a black film composed of copper phosphide and copper chloride is formed on the surface, and this yields the function of suppressing the generation of particles such as sludge composed of metallic copper or copper oxide caused by the disproportionation reaction of monovalent copper during the dissolution of the anode.

Nevertheless, the generation speed of the black film is strongly influenced by the current density of the anode, crystal grain size, phosphorous content, and so on, and, higher the current density, smaller the crystal grain size, and higher the phosphorous content, the foregoing generation speed becomes faster, and, as a result, it has become evident that the black film tends to become thicker as a result thereof.

Contrarily, lower the current density, larger the crystal grain size, and lower the phosphorous content, the foregoing generation speed becomes slower, and, as a result, the black film becomes thinner.

As described above, although a black film yields the function of suppressing the generation of particles such as metallic copper or copper oxide, when the black film is too thick, the film will drop off, and there is a major problem in that such drop off in itself will cause the generation of particles. Contrarily, when the black film is too thin, there is a problem in that the effect of suppressing the generation of metallic copper or copper oxide will deteriorate.

Therefore, in order to suppress the generation of particles from the anode, it is extremely important to optimize the current density, crystal grain size, and phosphorous content, respectively, and to form a stable black film with an appropriate thickness.

The present invention proposes a phosphorous copper anode representing the foregoing optimum values. The phosphorous copper anode of the present invention makes the crystal grain size of the phosphorous copper anode 10 to 1500 μm, preferably 20 to 700 μm, when the anode current density during electrolysis is 3 $A/dm^2$ or more, and makes the grain size of the phosphorous copper anode 5 to 1500 μm, preferably 10 to 700 μm, when the anode current density during electrolysis is less than 3 $A/dm^2$.

Moreover, it is desirable that the phosphorous content of the phosphorous copper anode be set between 50 and 2000 wtppm as the appropriate composition ratio for suppressing the generation of particles.

As a result of using the foregoing phosphorous copper anode, a black film layer with a thickness of 1000 μm or less and having copper phosphide or copper chloride as its principle component may be formed on the phosphorous copper anode surface upon electrolytic copper plating.

Although the anode current density upon performing electrolytic copper plating is usually 1 to 5 $A/dm^2$, when the subject is a new anode in which the black film has not been formed thereon, if electrolysis is performed at a high current density from the initial stages of such electrolysis, a black film having favorable adhesiveness cannot be obtained. Thus, it is necessary to perform the actual electrolysis after having performed electrolysis at a low current density of roughly 0.5 $A/dm^2$ for a few hours to nearly one day.

Nevertheless, since this kind of process is inefficient, as a result of conducting electrolysis after forming in advance a minute crystal layer having a crystal grain size of 1 to 100 μm on the phosphorous copper anode surface upon performing electrolytic copper plating, the long period of time required for the weak electrolysis as described above may be shortened, whereby the production efficiency is improved.

Needless to say, when employing a phosphorous copper anode having previously formed thereon a black film of a prescribed thickness, the preliminary processing of weak electrolysis as described above becomes unnecessary.

As a result of performing electrolytic copper plating with the phosphorous copper anode of the present invention as described above, the generation of sludge or the like can be reduced significantly, and it is further possible to prevent particles from reaching the semiconductor wafer and causing inferior plating upon such particles adhering to the semiconductor wafer.

The electrolytic plate employing the phosphorous copper anode of the present invention is particularly effective in the plating of a semiconductor wafer, but is also effective for copper plating in other sectors where fine lines are on the rise, and may be employed as an effective method for reducing the inferior ratio of plating caused by particles.

As described above, the phosphorous copper anode of the present invention yields an effect of suppressing the irruption of particles such as sludge composed of metallic copper or copper oxide, and significantly reducing the contamination of the object to be plated, but does not cause the decomposition of additives within the plating liquid or inferior plating resulting therefrom which occurred during the use of insoluble anodes in the past.

As the plating liquid, an appropriate amount of copper sulfate: 10 to 70 g/L (Cu), sulfuric acid: 10 to 300 g/L, chlorine ion 20 to 100 mg/L, additive: (CC-1220: 1 mL/L or the like manufactured by Nikko Metal Plating) may be used. Moreover, it is desirable that the purity of the copper sulfate be 99.9% or higher.

In addition, it is desirable that the plating temperature is 15 to 35° C., cathode current density is 0.5 to 5.5 A/dm$^2$, anode current density is 0.5 to 5.5 A/dm$^2$, and plating time is 0.5 to 100 hr. Although the suitable example of plating conditions is shown above, it does not necessarily need to be restricted to the above-mentioned conditions.

EXAMPLES AND COMPARATIVE EXAMPLES

Next, the Examples of the present invention are explained. Further, these Examples are merely illustrative, and the present invention shall in no way be limited thereby.

anode, and a semiconductor was used as the cathode. The crystal grain size of these phosphorous copper anodes was 10 to 200 μm.

As the plating liquid, copper sulfate: 20 to 55 g/L (Cu), sulfuric acid: 10 to 200 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 1.0 to 5.0 A/dm$^2$, anode current density 1.0 to 5.0 A/dm$^2$, and plating time 19 to 96 hr. The foregoing conditions are shown in Table 1.

After the plating, the generation of particles and plate appearance were observed. The results are similarly shown in Table 1.

Regarding the particle amount, after having performed electrolysis under the foregoing electrolytic conditions, the plating liquid was filtered with a filter of 0.2 μm, and the weight of the filtrate was measured thereby.

Regarding the plate appearance, after having performed electrolysis under the foregoing electrolytic conditions, the object to be plated was exchanged, plating was conducted for 3 minutes, and the existence of burns, clouding, swelling, abnormal deposition, foreign material adhesion and so on were observed visually.

As a result of the foregoing experiments, the amount of particles was less than 1 mg in Examples 1 to 4, and the plate appearance was favorable.

TABLE 1

| | | Examples | | | |
|---|---|---|---|---|---|
| | | 1 | 2 | 3 | 4 |
| Anode | Crystal Grain Size (μm) | 10 | 100 | 400 | 200 |
| | Phosphorous Content (ppm) | 300 | 400 | 600 | 500 |
| | Surface Layer | — | — | — | — |
| Plating Liquid | Metallic Salt | Copper Sulfate: 20 g/L(Cu) | Copper Sulfate: 55 g/L(Cu) | Copper Sulfate: 20 g/L(Cu) | Copper Sulfate: 55 g/L(Cu) |
| | Acid | Sulfuric Acid: 200 g/L | Sulfuric Acid: 10 g/L | Sulfuric Acid: 200 g/L | Sulfuric Acid: 10 g/L |
| | Chlorine Ion (ppm) | 60 | 60 | 60 | 60 |
| Additive | CC-1220: 1 mL/L | CC-1220: 1 mL/L (Nikko Metal Plating) | CC-1220: 1 mL/L (Nikko Metal Plating) | CC-1220: 1 mL/L (Nikko Metal Plating) | (Nikko MetalPlating) |
| Electrolytic Conditions | Bath Amount (mL) | 700 | 700 | 700 | 700 |
| | Bath Temperature (° C.) | 30 | 30 | 30 | 30 |
| | Cathode | Semiconductor Wafer | Semiconductor Wafer | Semiconductor Wafer | Semiconductor Wafer |
| | Cathode Area (dm$^2$) | 0.4 | 0.4 | 0.4 | 0.4 |
| | Anode Area (dm$^2$) | 0.4 | 0.4 | 0.4 | 0.4 |
| | Cathode Current Density (A/dm$^2$) | 1.0 | 2.0 | 4.0 | 5.0 |
| | Anode Current Density (A/dm$^2$) | 1.0 | 2.0 | 4.0 | 5.0 |
| | Time (h) | 96 | 48 | 24 | 19 |
| Evaluation Results | Particle Amount (mg) | <1 | <1 | <1 | <1 |
| | Plate Appearance | Favorable | Favorable | Favorable | Favorable |

Regarding the particle amount, after having performed electrolysis under foregoing electrolytic conditions, the plating liquid was filtered with a filter of 0.2 μm, and the weight of the filtrate was measured thereby. Regarding the plate appearance, after having performed electrolysis under the foregoing electrolytic conditions, the object to be plated was exchanged, plating was conducted for 3 min., and the existence of burns, clouding, swelling, abnormal deposition, foreign material adhesion andso on were observed visually.

In other words, the present invention shall include all other modes or modifications other than these Examples within the scope of the technical spirit of this invention.

Examples 1 to 4

As shown in Table 1, phosphorous copper having a phosphorous content of 300 to 600 wtppm was used as the

Examples 5 to 8

As shown in Table 2, phosphorous copper having a phosphorous content of 500 wtppm was used as the anode, and a semiconductor was used as the cathode. The crystal grain size of these phosphorous copper anodes was 200 μm.

As the plating liquid, copper sulfate: 55 g/L (Cu), sulfuric acid: 10 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 1.0 to 5.0 A/dm$^2$, anode current density 1.0 to 5.0 A/dm$^2$, and plating time 24 to 48 hr.

With the foregoing Examples 5 to 8, in particular, illustrated are examples in which minute crystal layers having a crystal grain size of 5 μm and 10 μm were previously formed on the anode surface at a thickness of 100 μm, and a black film was also formed thereon at a thickness of 100 μm and 200 μm.

The foregoing conditions are shown in Table 2.

After the plating, the generation of particles and plate appearance were observed. The results are similarly shown in Table 2. Moreover, the observation of the amount of particles and the plate appearance was pursuant to the same method as with Examples 1 to 4.

As a result of the foregoing experiments, the amount of particles was less than 1 mg in Examples 5 to 8, and the plate appearance was favorable.

Further, as shown in Table 2, in comparison to Examples 1 to 4, a prescribed plate was acquired in a short period of time with a relatively low current density. This is considered to be because minute crystal layers having a crystal grain size of 5 μm and 10 μm were previously formed on the anode surface at a thickness of 100 μm, and a black film was also formed thereon at a thickness of 100 μm and 200 μm.

Accordingly, it is evident that previously forming a minute crystal layer having a crystal grain diameter of 1 to 100 μm or a black film layer on the phosphorous copper anode surface is effective in forming a stable plate coating without any particles in a short period of time.

As shown in Table 3, phosphorous copper having a phosphorous content of 500 wtppm was used as the anode, and a semiconductor was used as the cathode. The crystal grain size of these phosphorous copper anodes was 3 μm and 2000 μm, which are both outside the scope of the present invention.

As the plating liquid, copper sulfate: 55 g/L (Cu), sulfuric acid: 10 g/L, chlorine ion 60 mg/L, additive [brightening agent, surface active agent] (Product Name CC-1220: manufactured by Nikko Metal Plating): 1 mL/L were used. The purity of the copper sulfate within the plating liquid was 99.99%.

The plating conditions were plating temperature 30° C., cathode current density 1.0 to 5.0 A/dm$^2$, anode current density 1.0 to 5.0 A/dm$^2$, and plating time 19 to 96 hr. The foregoing conditions are shown in Table 3.

After the plating, the generation of particles and plate appearance were observed. The results are similarly shown in Table 3.

Moreover, the observation of the amount of particles and the plate appearance was pursuant to the same method as with the foregoing Examples. As a result of the foregoing experiments, the amount of particles in Comparative Examples 1 to 3 reached 425 to 2633 mg, and the plate appearance was also unfavorable.

Accordingly, it has been confirmed that if the crystal grain size of the phosphorous copper anode is excessively large or small, the generation of particles will increase. Thus, it is evident that the optimization of the phosphorous copper anode is important.

TABLE 2

| | | Examples | | | |
|---|---|---|---|---|---|
| | | 5 | 6 | 7 | 8 |
| Anode | Crystal Grain Size B8 (μm) | 200 | 200 | 200 | 200 |
| | Phosphorous Content (ppm) | 500 | 500 | 500 | 500 |
| | Surface Layer | Crystal Grain Size 5 μm Minute Crystal Layer Thickness 100 μm | Crystal Grain Size 10 μm Minute Crystal Layer Thickness 100 μm | Black Film 100 μm | Black Film 200 μm |
| Plating Liquid | Metallic Salt | Copper Sulfate: 55 g/L(Cu) | Copper Sulfate: 55 g/L(Cu) | Copper Sulfate: 55 g/L(Cu) | Copper Sulfate: 55 g/L(Cu) |
| | Acid | Sulfuric Acid: 10 g/L | Sulfuric Acid: 10 g/L | Sulfuric Acid: 10 g/L | Sulfuric Acid: 10 g/L |
| | Chlorine Ion | 60 | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Amount (mL) | 700 | 700 | 700 | 700 |
| | Bath Temperature (° C.) | 30 | 30 | 30 | 30 |
| | Cathode | Semiconductor Wafer | Semiconductor Wafer | Semiconductor Wafer | Semiconductor Wafer |
| | Cathode Area (dm$^2$) | 0.4 | 0.4 | 0.4 | 0.4 |
| | Anode Area (dm$^2$) | 0.4 | 0.4 | 0.4 | 0.4 |
| | Cathode Current Density (A/dm$^2$) | 2.0 | 4.0 | 2.0 | 4.0 |
| | Anode Current Density (A/dm$^2$) | 2.0 | 4.0 | 2.0 | 4.0 |
| | Time (h) | 48 | 24 | 24 | 24 |
| Evaluation Results | Particle Amount (mg) | <1 | <1 | <1 | <1 |
| | Plate Appearance | Favorable | Favorable | Favorable | Favorable |

Regarding the particle amount, after having performed electrolysis under the foregoing electrolytic conditions, the plating liquid was filtered with a filter of 0.2 μm, and the weight of the filtrate was measured thereby. Regarding the plate appearance, after having performed electrolysis under the foregoing electrolytic conditions, the object to be plated was exchanged, plating was conducted for 3 min., and the existence of burns, couding, cwelling, abnormal deposition, foreign material adhesionand so on were observed visually.

TABLE 3

| | | Comparative Examples | | | |
|---|---|---|---|---|---|
| | | 1 | 2 | 3 | 4 |
| Anode | Crystal Grain Size (μm) | 3 | 2000 | 3 | 2000 |
| | Phosphorous Content (ppm) | 500 | 500 | 500 | 500 |
| | Surface Layer | — | — | — | — |
| Plating Liquid | Metallic Salt | Copper Sulfate: 55 g/L(Cu) | Copper Sulfate: 55 g/L(Cu) | Copper Sulfate: 55 g/L(Cu) | Copper Sulfate: 55 g/L(Cu) |
| | Acid | Sulfuric Acid: 10 g/L | Sulfuric Acid: 10 g/L | Sulfuric Acid: 10 g/L | Sulfuric Acid: 10 g/L |
| | Chlorine Ion | 60 | 60 | 60 | 60 |
| | Additive | CC-1220: 1 mL/L (Nikko Metal Plating) | CC-1220: 1 mL/L (Nikko Metal Plating) | CC-1220: 1 mL/L (Nikko Metal Plating) | CC-1220: 1 mL/L (Nikko Metal Plating) |
| Electrolytic Conditions | Bath Amount (mL) | 700 | 700 | 700 | 700 |
| | Bath Temperature (° C.) | 30 | 30 | 30 | 30 |
| | Cathode | Semiconductor Wafer | Semiconductor Wafer | Semiconductor Wafer | Semiconductor Wafer |
| | Cathode Area ($dm^2$) | 0.4 | 0.4 | 0.4 | 0.4 |
| | Anode Area ($dm^2$) | 0.4 | 0.4 | 0.4 | 0.4 |
| | Cathode Current Density (A/$dm^2$) | 1.0 | 2.0 | 4.0 | 5.0 |
| | Anode Current Density (A/$dm^2$) | 1.0 | 2.0 | 4.0 | 5.0 |
| | Time (h) | 96 | 48 | 24 | 19 |
| Evaluation Results | Particle Amount (mg) | 425 | 1522 | 758 | 2633 |
| | Plate Appearance | Inferior | Inferior | Inferior | Inferior |

Regarding the particle amount, after having performed electrolysis under the foregiong electrolytic conditions, the plating liquid filtered with a filter of 0.2 μm, and the weight of the filtrate was measured thereby. Regarding the plate appearance, after having performed electrolysis under the foregoing electrolytic conditions, the object to be plated was exchanged, plating was conducted for 3 min., and the existence of burns, clouding, swelling, abnormal deposition, foreign material adhesion andso on were observed visually.

The present invention yields a superior effect in that it is capable of suppressing the generation of particles such as sludge produced on the anode side within the plating bath, and capable of significantly preventing the adhesion of particles to a semiconductor wafer.

The invention claimed is:

1. An electrolytic copper plating method, comprising the steps:

employing phosphorous copper as an anode, performing electrolytic copper plating with said anode, making the crystal grain size of said phosphorous copper anode 100 to 1500 μm before said step of performing electrolytic copper plating, and forming a minute crystal layer having a crystal grain size of 1 to 100 μm on a surface of said phosphorous copper anode in advance of said step of performing electrolytic copper plating.

2. An electrolytic copper plating method according to claim 1, wherein said crystal grain size of said phosphorous copper anode is 100 to 700 μm.

3. An electrolytic copper plating method according to claim 2, wherein said phosphorous copper anode has a phosphorous content of 50 to 2,000 wt ppm.

4. An electrolytic copper plating method according to claim 3, wherein a black film which has a thickness of 1000 μm or less and which has one of copper phosphide and copper chloride as a principle component is formed on said phosphorus copper anode.

5. An electrolytic copper plating method according to claim 4, wherein said step of performing electrolytic copper plating is performed on a semiconductor wafer.

6. An electrolytic copper plating method according to claim 1, wherein said phosphorous copper anode has a phosphorous content of 50 to 2,000 wt ppm.

7. An electrolytic copper plating method according to claim 1, wherein a black film which has a thickness of 1000 μm or less and which has one of copper phosphide and copper chloride as a principle component is formed on said phosphorous copper anode.

8. An electrolytic copper plating method according to claim 1, wherein said step of performing electrolytic copper plating is performed on a semiconductor wafer.

9. A phosphorous copper anode for electrolytic copper plating characterized in that phosphorous copper is used as the anode for performing electrolytic copper plating, the crystal grain size of said phosphorous copper anode is 5 to 1500 μm and said phosphorous copper anode has a surface with a minute crystal layer having a crystal grain size of 1 to 100 μm.

10. A phosphorous copper anode according to claim 9, wherein said crystal grain size of said phosphorous copper anode is 100 to 700 μm.

11. A phosphorous copper anode according to claim 10, wherein said phosphorous copper anode has a phosphorous content of 50 to 2,000 wt ppm.

12. A phosphorous copper anode according to claim 11, wherein said phosphorous copper anode has a black film which has a thickness of 1000 μm or less and which has one of copper phosphide and copper chloride as a principle component.

13. A phosphorous copper anode according to claim 9, wherein said phosphorous copper anode has a phosphorous content of 50 to 2,000 wt ppm.

14. A phosphorous copper anode according to claim 9, wherein said phosphorous copper anode has a black film which has a thickness of 1000 μm or less and which has one of copper phosphide and copper chloride as a principle component.

* * * * *

UNITED STATES PATENT AND TRADEMARK OFFICE

CERTIFICATE OF CORRECTION

PATENT NO. : 7,138,040 B2
APPLICATION NO. : 10/362152
DATED : November 21, 2006
INVENTOR(S) : Okabe et al.

It is certified that error appears in the above-identified patent and that said Letters Patent is hereby corrected as shown below:

Column 2, line 30, "5 to 1500 μL m when," should read --5 to 1500 μm when--

Table 2 "of burns, couding, cwelling," should read --of burns, clouding, swelling--

Table 3 "adhesion andso on" should read --adhesion and so on--

Claim 9, column 10, line 39, "anode is 5 to" should read --anode is 100 to--

Signed and Sealed this

Nineteenth Day of June, 2007

JON W. DUDAS
*Director of the United States Patent and Trademark Office*